US007748465B2

(12) United States Patent
Bryant, Jr.

(10) Patent No.: US 7,748,465 B2
(45) Date of Patent: Jul. 6, 2010

(54) PRODUCTION TUBING HYDRAULIC RELEASE MECHANISM AND METHOD OF USE

(75) Inventor: Charles L. Bryant, Jr., LaPlace, LA (US)

(73) Assignee: Rattler Tools, LLC, Harvey, LA (US)

( * ) Notice: Subject to any disclaimer, the term of this patent is extended or adjusted under 35 U.S.C. 154(b) by 663 days.

(21) Appl. No.: 11/518,107

(22) Filed: Sep. 9, 2006

(65) Prior Publication Data

US 2008/0060817 A1 Mar. 13, 2008

(51) Int. Cl.
*E21B 17/02* (2006.01)
*E21B 23/00* (2006.01)

(52) U.S. Cl. ..... 166/377; 166/242.6

(58) Field of Classification Search ..... 166/377, 166/242.6, 242.7
See application file for complete search history.

(56) References Cited

U.S. PATENT DOCUMENTS

| | | | | |
|---|---|---|---|---|
| 4,494,609 | A * | 1/1985 | Schwendemann | 166/336 |
| 5,323,853 | A * | 6/1994 | Leismer et al. | 166/55 |
| 6,213,206 | B1 * | 4/2001 | Bakke | 166/242.7 |
| 6,626,244 | B2 * | 9/2003 | Powers | 166/373 |
| 7,066,270 | B2 * | 6/2006 | Murray | 166/380 |
| 7,373,974 | B2 * | 5/2008 | Connell et al. | 166/242.6 |

* cited by examiner

*Primary Examiner*—David J Bagnell
*Assistant Examiner*—David Andrews
(74) *Attorney, Agent, or Firm*—Law Office of Jesse D. Lambert, LLC

(57) ABSTRACT

A release mechanism for removing a subsurface safety control valve from a production string in a well bore is mounted below the safety valve in operational engagement with the safety valve and the production string. The release mechanism has a two-part construction, with the upper part being normally locked to the lower part and released from the lower part when changing of the safety valve is required.

12 Claims, 4 Drawing Sheets

PRODUCTION TUBING HYDRAULIC RELEASE MECHANISM AND METHOD OF USE

BACKGROUND OF THE INVENTION

This invention relates to a release mechanism for use in wells, such as oil and gas wells, and more particularly to a release mechanism for production tubing located below subsurface control safety valves.

The mineral exploration and production industry routinely uses subsurface control safety valves for control of fluid flow, such as oil and gas in the tubing positioned in a well bore. Many such valves are hydraulically operated pistons for holding the valves open in response to hydraulic fluid pressure in the downhole tubing. Should any damage occur to valve or in the tubing below the subsurface control safety valve, an operator must stop the production flow and pull out the entire production tubing string to change the damaged valve, as well as any other components that became damaged.

The same situation exists for other production tubing equipment: should one of the production tubing mechanisms is damaged, substantial time is spent in closing the faulty mechanism and then raising up the entire production string and/or drill string to change the damaged piece of equipment. This equipment is usually located thousands of feet below the surface and when a change of the damaged equipment becomes necessary, the well operator usually constructs a large derrick suitable for lifting the production string from the wellbore.

The present invention contemplates elimination of drawbacks associated with conventional practices and provision of a hydraulic release mechanism that can be mounted below subsurface control safety valves or other similar mechanisms to close off the production string and allow only the portion of the production string above the release mechanism to be removed for repair or replacement.

SUMMARY OF THE INVENTION

It is, therefore, an object of the present invention to provide a hydraulic release mechanism for use in production tubing.

It is another object of the present invention to provide a hydraulic release mechanism that can be mounted as part of the production string below the subsurface safety control valve with minimal interruption of production or drilling activities in the well bore.

These and other objects of the present invention are achieved through a provision of a device and method of taking a subsurface safety valve out of service by retrieving the safety valve and a portion of the production string above the subsurface safety control valve from a well bore. The device provides for a housing comprising an upper portion and a lower portion fitted at least in part in the upper portion. The housing is positioned in the production string in line with an below the subsurface safety valve. The upper portion and the lower portion of the housing is each connected to the production string.

A locking assembly normally retains the upper portion locked to the lower portion by causing latching dogs of a latching assembly to engage the lower portion. The upper portion is hydraulically connected to a power source on the surface. The power source controls engagement of the upper portion to the lower portion. When the locking power source is activated to stop provision of power to the housing, a releasing power line delivers hydraulic power to the housing, causing disengagement of the upper portion from the lower portion. As a result, the upper portion of the housing and the subsurface safety valve with a portion of the production string above the upper portion can be removed from the well bore without the need to retrieve the entire production string to change the damaged safety valve.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
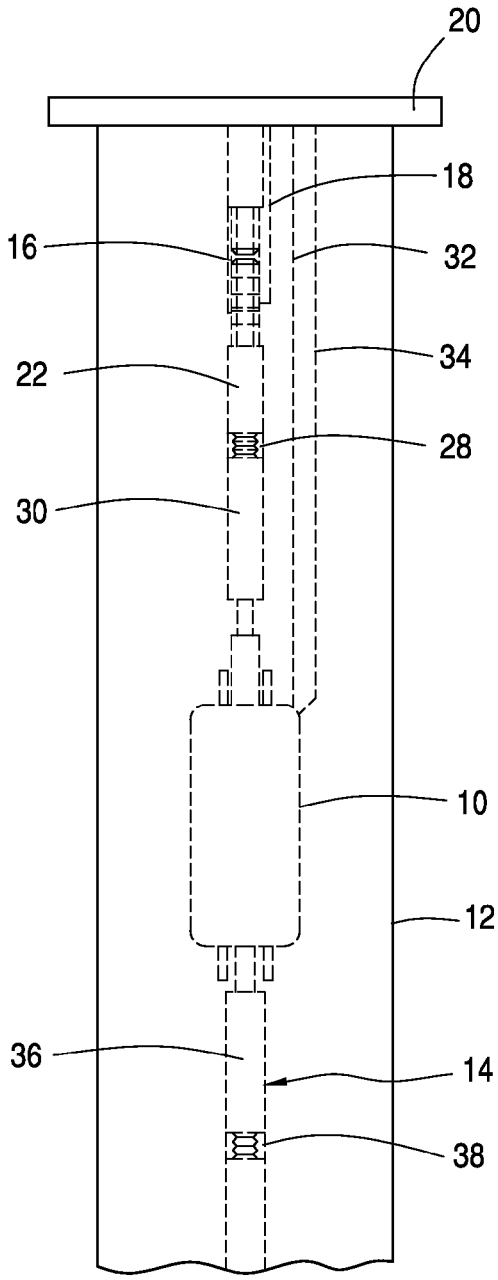
FIG. 1 is a schematic view illustrating position of the release device of the present invention in the production tubing.
Figure 2:
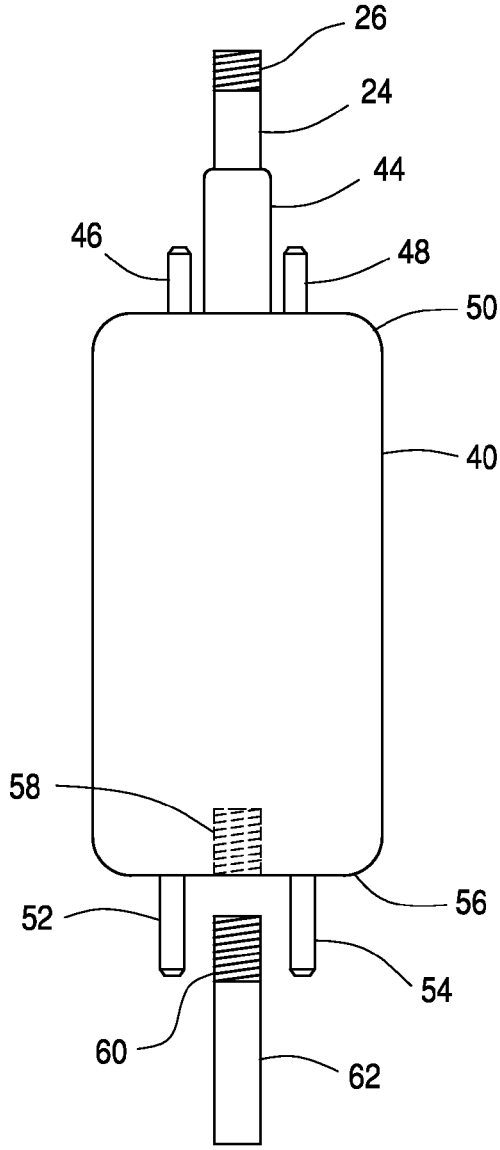
FIG. 2 is a perspective view of the release device in accordance with the present invention.

Turning now to the drawings in more detail, numeral 10 designates the release device in accordance with the present invention. As shown in FIG. 1, the device 10 is designed for positioning in a well bore 12 as part of the production or drilling tubing 14. A subsurface safety control valve 16 is mounted above the release device 10 in operational line with the tubing 14. The safety valve 16 prevents build up of excessive pressure in the production tubing 14 and is controlled by a control line 18 from the surface. Normally, a wellhead and hanger 20 are positioned above the safety valve 16.

A tubing sub 22 is mounted above the release device 10 and is connected thereto by suitable connector sub 24 provided with external threads 26. A nipple connector 28 may be positioned between the portions of the sub 22. A portion 30 of the sub 22 can function as a tubing plug. A locking control line 32 extends from the surface to the device 10 for positive locking of the latching dogs under normal operating conditions. A separate control line 34 is a surface-operated line in operational communication with the device 10 for facilitating positive release of the device 10 when necessary. A lower end of the device 10 is connected to a production-tubing sub 36, which may also be provided with a nipple connector 38.

The device 10 comprises a hollow housing 40 defining a chamber 42 therein. The housing 40 has a corrosion cap 44 through which the tubing connector 24 extends. A pair of control line nipples 46 and 48 are connected to the top 50 of the housing 40. A pair of similar control line nipples 52 and 54 are connected to a bottom 56 of the housing 40. The lower part of the housing 40 is provided with inner threads 58 which are adapted for engagement with exterior threads 60 of a production tubing sub 62.

Figure 4:
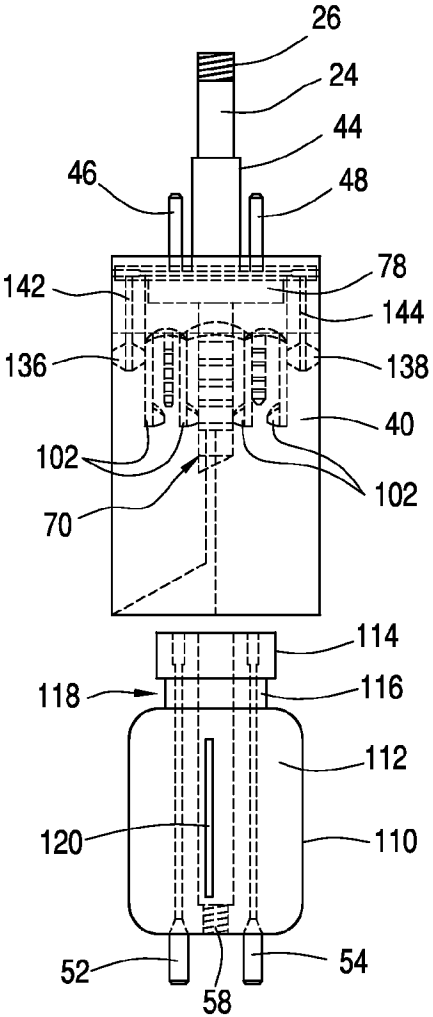
FIG. 4 is a sectional view illustrating the release device of the present invention in a released position.

Mounted inside the housing 40 is a seal assembly 70, which comprises an elongated mandrel 72. A plurality of sealing O-rings 74 is mounted in a surrounding relationship over a lower part of the mandrel 72. The lowermost part 76 of the mandrel 72 is cut at a bevel to facilitate positioning of the seal assembly 70 in the housing 40. The mandrel 72 is secured to a ring-shaped connector 78, which has suitable openings therethrough for extension of the mandrel 72 as well as control lines 80, 82. The control lines 80, 82 are schematically shown in phantom lines in FIGS. 3 and 4.

An opening 84 is formed in the top plate 86 of the housing 40. A nipple connector is inserted in the opening 84 for receiving pressure from a hydraulic line 32 extending from the surface. An opening 88 is formed in a sidewall 90 of the housing 40 and a nipple connector is inserted in the opening 88. A release hydraulic line 34 is connected to the chamber 42 through the nipple connector mounted in the opening 88.

The seal assembly 70 comprises a latching dog assembly 100. The latching dog assembly 100 comprises an upper cylindrical part 101 and a plurality of latching dogs, or latching members 102 supported by elongated legs 104, which are secured to the upper part 101. The latching dogs are spaced circumferentially about the circumference of the cylindrical part, 101 and are adapted for latching onto a lower portion 110 of the release device 10.

The lower portion 110 of the device 10 comprises a main body 112 and an upper part 114. A reduced diameter middle part 116 connects the main body 112 with the upper part 114. A reduced diameter annular space 118 is formed between the upper part 114 and the main body 112. The latching dogs 102 engage the middle part 116 of the lower portion 110 when the device 10 is in its normally locked position shown in FIG. 3. The lower portion 110 fits within the upper portion of the housing 40 and telescopically slides out of engagement with the upper portion when the device 10 is in a released mode.

An elongated positioning guide 120 is secured on the exterior of the lower portion 110 to facilitate alignment of the lower portion within the housing 40. An elongated mandrel 130 extends through the center of the lower portion 110. The externally threaded part 58 is connected to the mandrel 130 to allow connection of the device 10 to the production tubing 62. The flow of production fluid is allowed to pass through the device 10, by entering sub 24 and exiting through the end 58 of the mandrel 130.

The device 10 comprises a locking dog assembly that facilitates release of the upper portion of the device 10. The locking assembly comprises two or more locking dogs, or locking members 136, 138 secured to a transverse plate 140 mounted above the latching assembly 100. The plate 140 acts as a piston, moving up and down within the chamber 42. Preferably the number of locking dogs corresponds to the number of the latching dogs 102.

Figure 3:
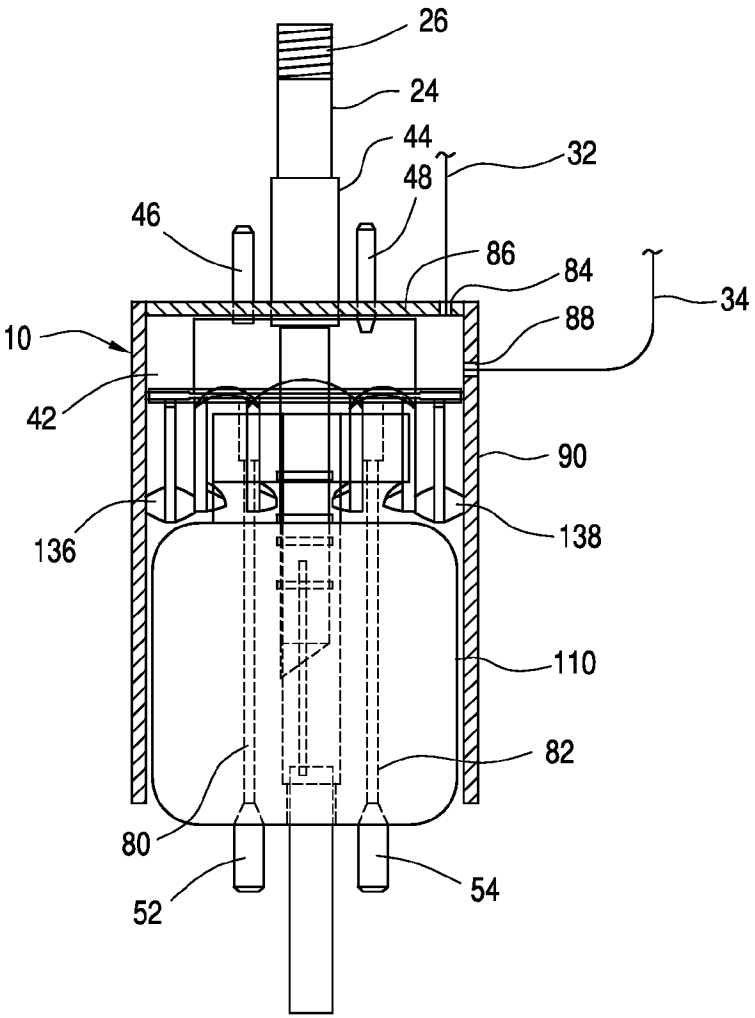
FIG. 3 is a sectional view illustrating the release device of the present invention in a normally locked position.
Figure 6:
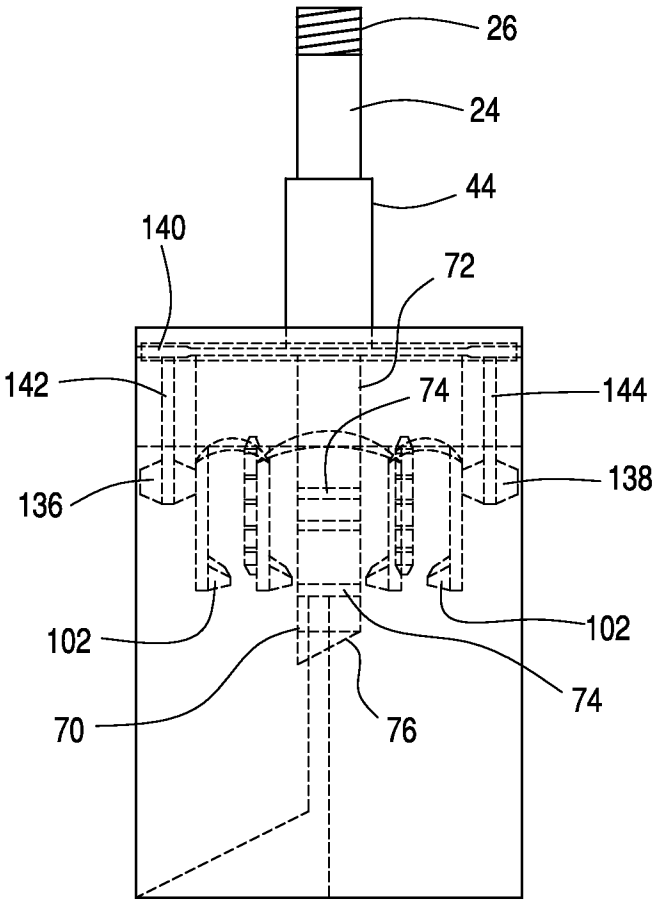
FIG. 6 is a detail view illustrating position of the latching dogs in a released condition.
Figure 5:
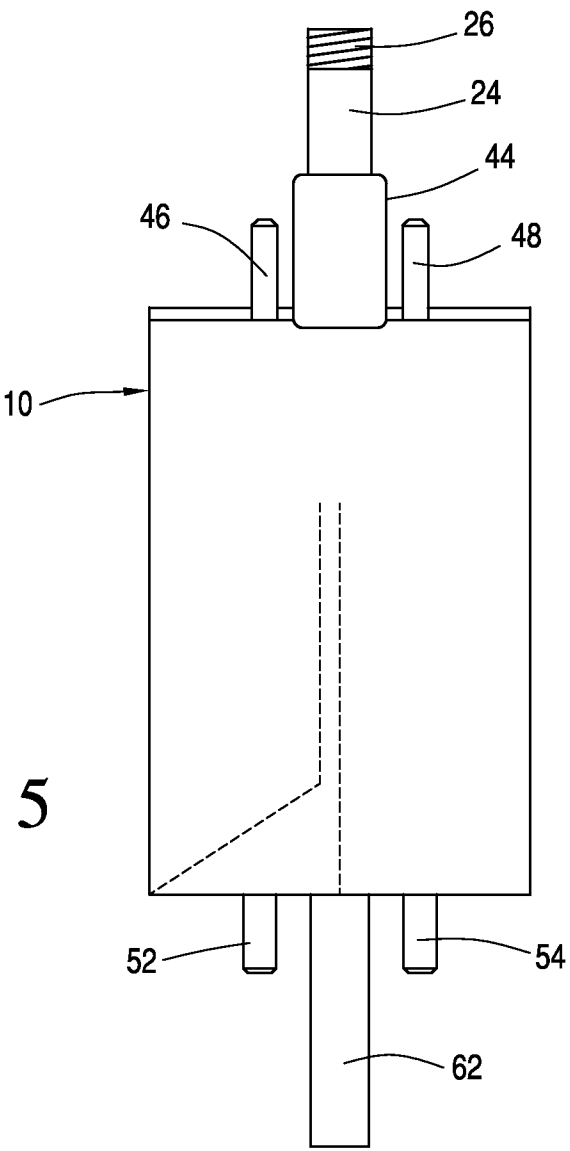
FIG. 5 is a detail view illustrating the release device housing with control line nipple connections.
Figure 9:
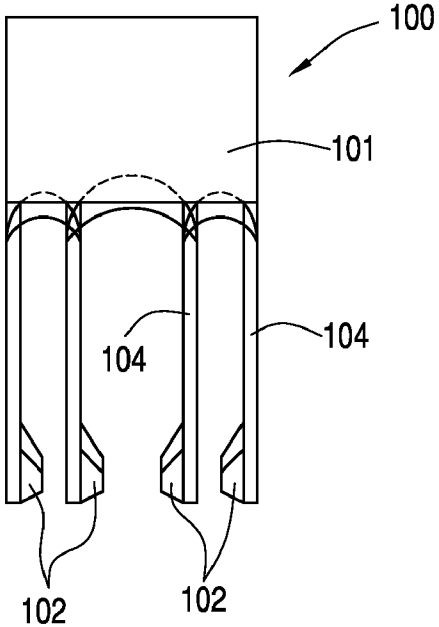
FIG. 9 is a detail view illustrating a latching dog assembly of the release device in accordance with the present invention.
Figure 8:
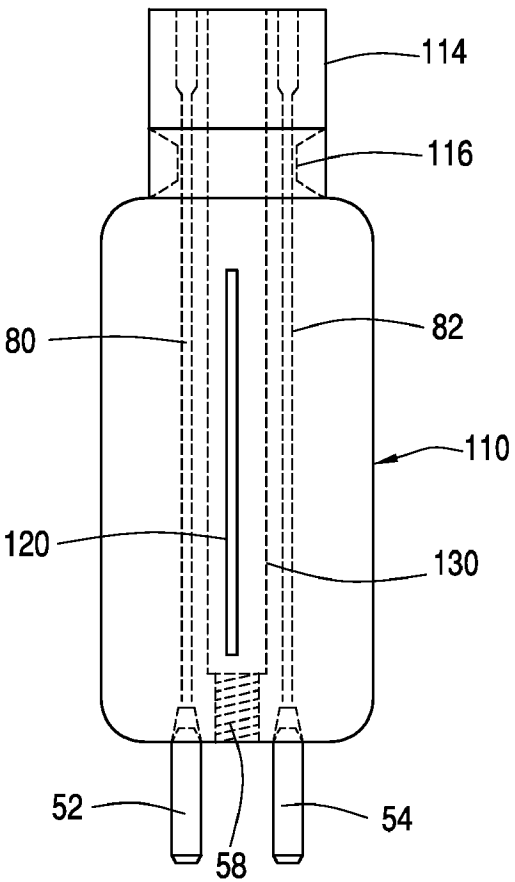
FIG. 8 is a sectional view of the lower portion showing control lines extending through the lower portion.
Figure 7:
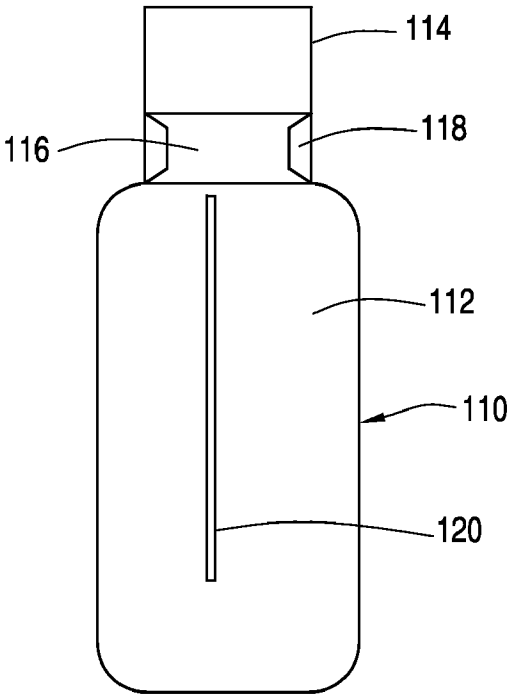
FIG. 7 is a perspective view of a lower portion of the release device in accordance with the present invention.

In a normally locked position shown in FIG. 3, the locking dogs 136, 138 are located at about the same horizontal plane as the latching dogs 102. In a released position, the locking dogs 136, 138 move upwardly, away from the latching dogs 102. The legs 104 that carry the latching dogs 102 have the ability to spring towards and away from the seal assembly 70.

When the locking dogs 136, 138 move upwardly, the latching dogs 102 can move out of engagement with the middle part 116 of the lower portion 110 and release the upper portion of the device 10 from its engagement with the fixedly connected lower portion 110. The lower portion 110, being secured to the production tubing 62, remains in position in the well, while the upper portion with the seal assembly 70, the latching assembly 100 and the locking assembly, is released and can be retrieved from the well bore. When the upper portion and the lower portion of the device 10 are separated, an operator can remove the subsurface safety control valve that needs repair or replacement.

The locking dogs 136, 138 are secured by respective legs 142, 144 to the transverse plate 140. The plate 140 acts as a piston under the force of hydraulic power delivered from the surface. When the hydraulic force is delivered through the line 32 into the chamber 42, it acts upon the upper surface of the plate 140, keeping the locking dogs 136, 138 in a down position and retaining the latching dogs 102 in a locked position. When the hydraulic force is no longer supplied through the line 32 and the pressure is released through the line 34, the plate 140 slides upwardly, carrying locking dogs 136, 138 away from the latching dogs 102, thus disconnecting the engagement of the upper portion with the seal assembly 70 from the lower portion 110.

The device 10 of the present invention can be placed in the production string below the subsurface safety control valve in order to allow changing of damaged safety valves without pulling the entire production string and the packer. As a result, the device 10 allows cutting down on rig costs and the downtime in the production of the well. The device 10 can also be used to place in the production string below paraffin lines in the wellbore. This will allow the operator to change out the damaged lines without pulling the entire production string, seal assembly, and/or the packer. Advantageously, the wire line work is reduced.

The device 10 of the present invention can also be used for placing in the production string below injection mandrels for easy recovery. Such use will allow elimination of electric wire line work, and loss of control lines in the well bore can be substantially reduced. Another potential use of this device is to create a simple way of recovering production tubing that can occur due to a struck pipe. The device will allow easier removal and recovery procedures so fewer control lines will be lost on a stuck pipe.

Many changes and modifications can be made in the design of the present invention without departing from the spirit thereof. I therefore pray that my rights to the present invention be limited only by the scope of the appended claims.

I claim:

1. A release device for releasing a portion of a well production string below a subsurface safety valve installed in the well production string, the device comprising:

a hollow housing having an upper portion and a lower portion fitted at least in part within the upper portion;

a means for connecting said housing below the subsurface safety valve in line with the production string;

a seal assembly mounted in the upper portion of said housing;

a locking means positioned in the upper portion of said housing for releasably locking the lower portion of the housing to the upper portion of the housing, said locking means comprising a latching assembly releasably engaging the lower portion and a locking assembly for retaining said latching assembly in a normally locked position with said lower portion, wherein said locking assembly comprises a transverse plate mounted for slidable movement in the upper portion, said transverse plate allowing the seal assembly to extend therethrough, and wherein said latching assembly comprises a ring-shaped body, a plurality of legs extending downwardly from said ring-shaped body, each of said legs carrying a latching member;

a means for securing the lower portion of the housing to the production string below said upper portion;

a first opening formed in the upper portion of the housing for communication with a source of power above said subsurface safety valve for retaining said locking means in a locked position;

a second opening formed in the upper portion of the housing for communication with a source of power above said subsurface safety valve for releasing said locking means and allowing the portion of the production string above the subsurface safety valve to be removed from a well bore, while retaining the lower portion in the well bore.

2. The apparatus of claim 1, wherein said locking assembly further comprises a plurality of locking members secured to the transverse plate and extending downwardly therefrom, said locking members normally retaining said latching members in engagement with the lower portion.

3. A release device for releasing a portion of a well production string below a subsurface safety valve installed in the well production string, the device comprising:

a hollow housing having an upper portion and a lower portion fitted at least in part within the upper portion;

a means for connecting said housing below the subsurface safety valve in line with the production string;

a seal assembly mounted in the upper portion of said housing, said seal assembly comprising an elongated mandrel carrying a plurality of sealing elements on an exterior surface thereof;

a locking means positioned in the upper portion of said housing for releasable locking the lower portion of the housing to the upper portion of the housing;

a means for securing the lower portion of the housing to the production string below said upper portion;

a first opening formed in the upper portion of the housing for communication with a source of power above said subsurface safety valve for retaining said locking means in a locked position;

a second opening formed in the upper portion of the housing for communication with a source of power above said subsurface safety valve for releasing said locking means and allowing the portion of the production string above the subsurface safety valve to be removed from a well bore, while retaining the lower portion in the well bore, and wherein said lower portion has an elongated tubular member mounted in the lower portion, and wherein said mandrel is configured for fitting in the tubular member.

4. The apparatus of claim 3, wherein said mandrel comprises a beveled lower part to facilitate positioning of the seal assembly in the tubular member.

5. A method of taking a subsurface safety valve out of surface, said subsurface safety valve being mounted in a production string in a well bore, the method comprising the steps:

providing a housing comprising an upper portion and a lower portion fitted at lease in part in the upper portion and positioning said housing in the well bore in line with the production string and the subsurface safety valve;

providing a tubular member extending through said lower portion and connecting said tubular member to the production string below said housing;

securing the upper portion to the production string below said subsurface safety valve;

normally retaining the upper portion in a locked position with the lower portion;

securing the lower portion of the housing to the production string below said upper portion;

providing a first opening in the upper portion of the housing and establishing communication with a source of power above said subsurface safety valve for retaining said upper portion in a locked position;

providing a second opening in the upper portion of the housing and establishing communication with a source of power above said subsurface safety valve for releasing said locking means;

delivering a release power to the upper portion through said second opening, thereby causing said upper portion to be released from said lower portion and allowing a portion of the production string above the subsurface safety valve to be removed from a well bore, while retaining the lower portion in the well bore.

6. The method of claim 5, further comprising the step of providing a seal assembly in the upper portion and releasably engaging the seal assembly with the tubular member.

7. The method of claim 6, further comprising the step of providing a latching assembly in the upper portion and releasably engaging the lower portion with said latching assembly.

8. The method of claim 7, further comprising a step of providing a locking assembly for retaining said latching assembly in a normally locked position with said lower portion.

9. The method of claim 8, wherein said lower portion comprises a generally cylindrical body having an upper part, a lower part and a reduced diameter middle part, and wherein said latching assembly is configured for releasably engaging the middle part of the lower portion.

10. The method of claim 8, wherein said locking assembly comprises a transverse plate mounted for slidable movement in the upper portion, said transverse plate allowing the seal assembly to extend therethrough.

11. The method of claim 10, wherein said locking assembly further comprises a plurality of locking members secured to the transverse plate and extending downwardly therefrom, said locking members normally retaining said latching members in engagement with the lower portion.

12. The method of claim 7, wherein said latching assembly comprises a ring-shaped body, a plurality of legs extending downwardly from said ring-shaped body, each of said legs carrying a latching member.

* * * * *